US005317234A

United States Patent [19]

Chojnacki

[11] Patent Number: 5,317,234

[45] Date of Patent: May 31, 1994

[54] MODE TRAP FOR ABSORBING TRANSVERSE MODES OF AN ACCELERATED ELECTRON BEAM

[75] Inventor: Eric P. Chojnacki, Woodridge, Ill.

[73] Assignee: The United States of America as represented by the United States Department of Energy, Washington, D.C.

[21] Appl. No.: 924,991

[22] Filed: Aug. 5, 1992

[51] Int. Cl.[5] ..... H01P 1/162; H05H 9/00

[52] U.S. Cl. ..... 315/5.41; 328/233; 333/228; 333/251

[58] Field of Search ..... 315/5.41, 5.42, 5.51, 315/5.52; 313/359.1, 360.1; 328/233, 227; 333/228, 251; 331/90

[56] References Cited

U.S. PATENT DOCUMENTS

| | | | |
|---|---|---|---|
| 3,153,767 | 10/1964 | Kyhl | 315/5.42 X |
| 3,428,922 | 2/1969 | Matthaei | 333/251 X |
| 4,017,760 | 4/1977 | Benoit et al. | 333/251 X |
| 4,540,960 | 11/1985 | Giordano | 333/228 |
| 4,906,896 | 3/1990 | Swenson | 328/233 X |
| 4,926,145 | 5/1990 | Flam et al. | 333/251 X |
| 5,017,881 | 5/1991 | Palmer | 328/233 |
| 5,187,408 | 2/1993 | Jödicke et al. | 333/251 X |

FOREIGN PATENT DOCUMENTS

| | | | |
|---|---|---|---|
| 95499 | 4/1989 | Japan | 328/233 |

OTHER PUBLICATIONS

Measurement of deflection-mode damping an an accelerating structure (J. Appl. Phys. 69 (9), 1 May 1991) 6 pages E. Chojnacki, W. Gai, C. Ho, R. Konecny, S. Mitingwa, J. Norem, M. Rosing.

*Primary Examiner*—Benny T. Lee

*Attorney, Agent, or Firm*—Mark P. Dvorscak; Robert J. Fisher; William R. Moser

[57] ABSTRACT

A mode trap to trap and absorb transverse modes formed by a beam in a linear accelerator includes a waveguide having a multiplicity of electrically conductive (preferably copper) irises and rings, each iris and ring including an aperture, and the irises and rings being stacked in a side-by-side, alternating fashion such that the apertures of the irises and rings are concentrically aligned. An absorbing material layer such as a dielectric is embedded in each iris and ring, and this absorbing material layer encircles, but is circumferentially spaced from its respective aperture. Each iris and ring includes a plurality of circumferentially spaced slots around its aperture and extending radially out toward its absorbing material layer.

6 Claims, 4 Drawing Sheets

MODE TRAP FOR ABSORBING TRANSVERSE MODES OF AN ACCELERATED ELECTRON BEAM

CONTRACTUAL ORIGIN OF THE INVENTION

The U.S. Government has rights in this invention pursuant to Contract No. W-31-109-ENG-38 between the U.S. Department of Energy and the University of Chicago.

BACKGROUND OF THE INVENTION

This invention relates to a mode trap to trap and absorb transverse modes in linear accelerators, and more particularly, in wake field accelerators.

A beam in a linear accelerator forms a deflection mode, or transverse field mode, in addition to an accelerator mode. Deflection modes in linear accelerators are generated by deviations of the beam from the geometrical axis.

They are the non-axisymmetric wake fields generated in accelerating cavities via beam misalignment with the cavity axis. Deflection modes result in the phenomena known as beam breakup (BBU) and the head-tail instability, both of which refer to uncontrolled transverse wandering and subsequent loss of the beam, or less severely, emittance degradation. Beam breakup is defined as a cumulative bunch-to-bunch effect, and head-tail is defined as an intra-bunch effect. The spawning of such modes in high-gradient structures will be inevitable given the requisite small-diameter cavity apertures and feasible beam alignment tolerances. Their amplitudes will also be large due to the high luminosities required for physics studies in a TeV electron linear collider.

The build-up of deflection modes in accelerating cavities is a problem in present accelerators and will be a major problem in any future high-gradient linear collider. The deflection mode will create forces on a trailing portion of the beam and subsequent bunches with adverse results.

The approach to the problem of deflection-mode dampening is that of considering eligible modes in slow-wave structures. Accelerating modes are axisymmetric $TM_{01}$ in nature, consisting of many axial harmonics in an iris-loaded waveguide, or consisting of one pure mode in a dielectric-lined waveguide. Deflection modes, however, are nonaxisymmetric hybrids containing both axial electric and magnetic fields. These hybrid modes are labeled $HEM_{mn}$ where m refers to the azimuthal harmonic and n is an ordering index not necessarily referring to radial harmonics. At cutoff, the dispersion relation for these hybrids degenerates to the conventional $TM_{mn}$ and $TE_{mn}$ waveguide modes, although the field amplitudes for TE modes are identically zero at cutoff. Of interest here, for dielectric-lined waveguide, are the $HEM_{11}$, $HEM_{21}$, and $HEM_{12}$ modes which correspond to the $TE_{11}$, $TE_{21}$, and $TM_{11}$ modes at cutoff, respectively. Among the physical features that differentiate the hybrid modes from the accelerating modes are obviously the composite electric and magnetic field components. The accelerating modes ($TM_{01}$) contain only the $E_r$, $B_\theta$, and $E_Z$ field components and one of the boundary conditions in dielectric-lined waveguide is $Ez=0$ at the conducting wall. The subscripts r, $\theta$, and z, used herein refer to the radial, r, transverse, $\theta$, and axial z components in a cylindrical coordinate system where E refers to the Electric field components and B refers to the magnetic field components. This is equivalent to $B_\theta$ requiring a surface current $K_z$ on the conducting wall. The hybrid modes, on the other hand, tend to contain all three electric and magnetic field components ($E_r$, $E_\theta$, $E_z$, $B_r$, $B_\theta$, and $B_z$) and have the additional boundary condition $E_\theta=O$ at the conducting wall which is equivalent to $B_z$ requiring a surface current $K_\theta$ there. This boundary condition can then be exploited to dampen the beam-deflecting hybrid modes by comprising the conducting wall of axial, closely spaced, insulated wires as shown in FIG. 1. The variables a and b indicate regions in the waveguide, relative to the radius r of the cross section of the waveguide of FIG. 1, in which the accelerating modes and hybrid modes may be confined. With such a segmented conductor the accelerating mode ($TM_{01}$) will be confined to the regions $r<b$ just as though the wall were a uniform conductor, but the hybrid modes will radiate to the region $r>b$ and further satisfy boundary conditions beyond the non-confining ones at $r=b$. The region $r>b$ can then be filled with rf absorbing material and the hybrid modes will be severely attenuated. The cavity quality factor Q of the hybrid modes will be lowered to what turn out to be single digit values while the accelerating modes remain essentially unaffected.

One approach to deflection-mode damping is shown by U.S. Pat. No. 5,017,881 to Palmer. This device shows an accelerating cavity having iris structures for damping unwanted frequencies generated in the cavity. This accelerating cavity having slotted irises requires meticulous design of relatively large apertures in the waveguide walls, tuned to particular wavelengths of specific waveguide deflection modes, with a subsequent external waveguide required to propagate these deflection modes to far-removed attenuating loads.

In a preliminary prior art design of a mode trap by the inventor and others, Chojnacki et. al, Measurement of Deflection-Mode Damping in an Accelerating Structure, J. Appl. Phys. 69, May 1, 1991, and shown in FIG. 1, a multiplicity of longitudinal wires are located around the periphery of a dielectric tubular chamber for the beam with an absorber sleeve of nonmetallic material over the wire arrangement and within the conventional metal housing. Tests show that the accelerator mode is not significantly affected whereas the transverse mode is absorbed within a short time period. However, the interior dielectric is not as efficient overall as an iris-loaded waveguide for acceleration purposes, so its application is limited to a few special circumstances.

In an iris-loaded waveguide a similar prior art scheme can be employed by segmenting the outer conducting wall to allow only axial currents and also segmenting the irises so as to allow only radial currents as shown in FIG. 2. The close proximity of the iris aperture to the beam in this case, however, requires special attention to be given to field arcing and construction tolerances.

Arcing across segmented conductors would be due to the $E_\theta$ field which must be continuous there rather than zero.

There is a need for a transverse mode trap that suppresses the deflection or transverse modes without limiting the accelerator modes.

Accordingly, it is an object of the present invention to provide a transverse mode trap that suppresses the deflection or transverse modes without limiting the accelerator modes.

It is a further object of the present invention to provide a mode trap that reduces or eliminates arcing under the influence of high electric fields.

Yet another object of the present invention is to provide a mode trap that facilitates easy construction.

SUMMARY OF THE INVENTION

A mode trap to trap and absorb transverse modes formed by a beam in a linear accelerator includes a waveguide having a multiplicity of electrically conductive (preferably copper) irises and rings, each iris and ring including an aperture, and the irises and rings being stacked in a side-by-side, alternating fashion such that the apertures of the irises and rings are concentrically aligned. An absorbing material layer such as a dielectric is embedded in each iris and ring, and this absorbing material layer encircles, but is circumferentially spaced from its respective aperture. Each iris and ring includes a plurality of circumferentially spaced notches around its aperture and extending radially out toward its embedded absorbing material layer.

The iris has at least four equi-spaced notches, and the ring has sixteen equi-spaced notches. The notches of the rings can have rounded edges at the aperture boundary. In this manner, the transverse mode formed by the accelerator beam is channeled through the notches in the rings and irises and is absorbed by the absorbing layer, without limiting the accelerator mode externally powered by a klystron and also formed by the accelerator beam.

In another embodiment the waveguide can be a niobium lined cavity having thin longitudinal strips of copper exposed to the interior to attenuate azimuthal wall currents. The niobium lined copper cavity is surrounded by a liquid helium jacket which in turn is surrounded by a liquid nitrogen jacket.

BRIEF DESCRIPTION OF THE DRAWINGS

The above-mentioned and other features of the invention will become more apparent and be best understood, together with the description, by reference to the accompanying drawings, in which.

DETAILED DESCRIPTION OF THE INVENTION

Figure 1:
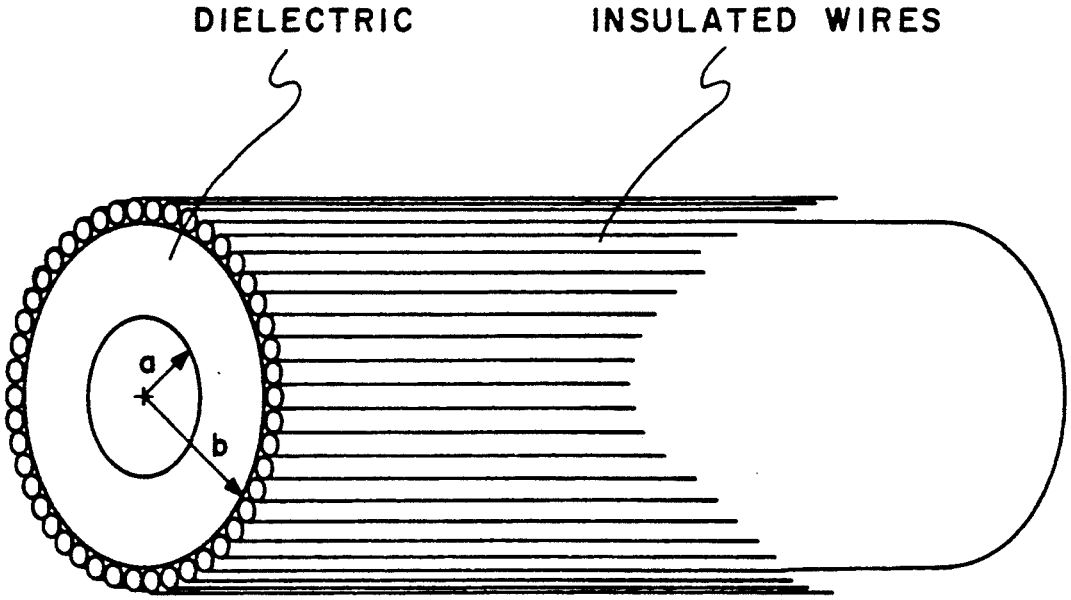
FIG. 1 (PRIOR ART)
FIG. 1 shows a preliminary prior art design of a mode trap in the form of a dielectric-lined waveguide with a segmented outer conductor.
Figure 2:
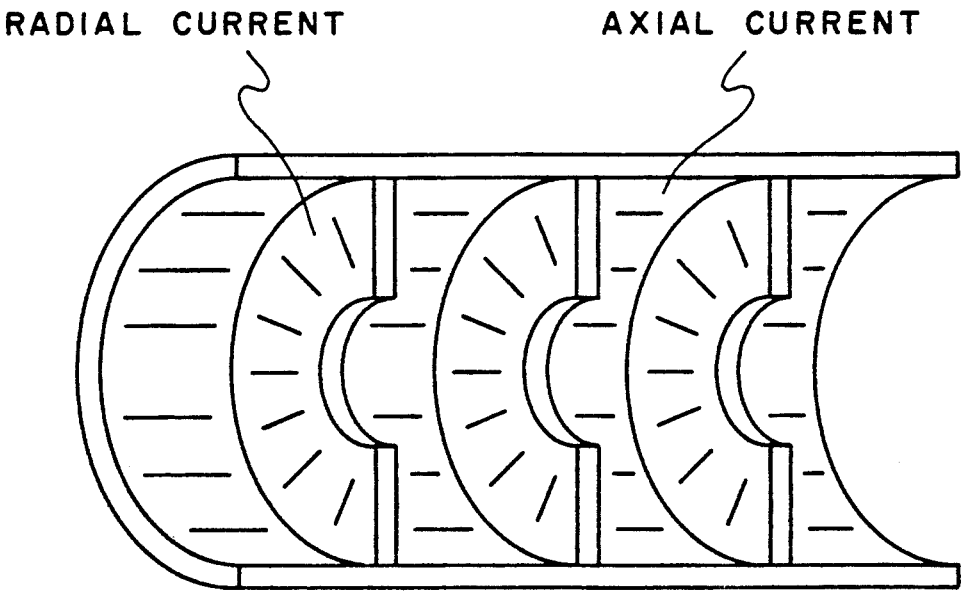
FIG. 2 (PRIOR ART)
FIG. 2 shows another preliminary prior art design of a mode trap in the form of an iris-loaded waveguide with a segmented outer conductor and segmented irises.
Figure 3:
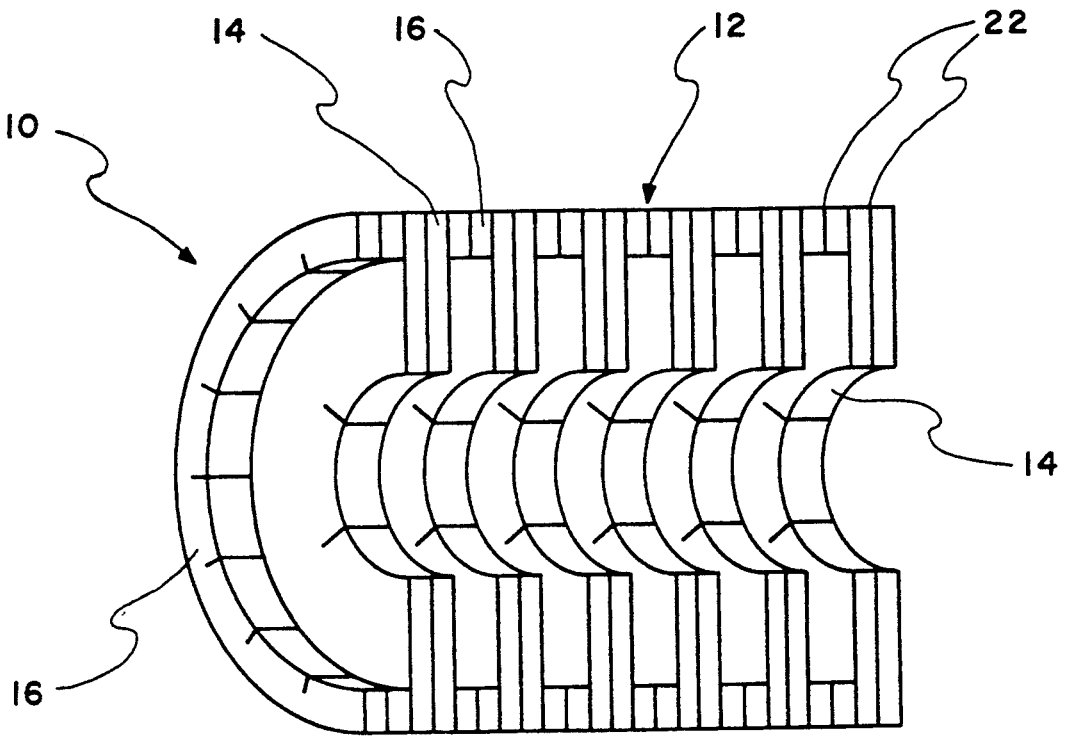
FIG. 3 shows a mode trap constructed according to one embodiment of the present invention.

Referring to FIG. 3, there is shown a mode trap 10 constructed according to one embodiment of the present invention. The mode trap 10 is an accelerating cavity, or waveguide 12, in a linear accelerator (not shown). The accelerator produces an electron beam which passes through the waveguide 12. The beam produced has a deflection mode and an accelerator mode. It is desired that the accelerator mode be contained and pass through the waveguide, and that the deflection mode be damped and absorbed.

The mode trap 10 includes a multiplicity of thinly constructed irises 14 and rings 16, each electrically conductive, and arranged in a side-by-side and alternating arrangement to form the longitudinal waveguide 12. The preferred material for the irises and rings is copper. Also shown in FIG. 3 for each iris and ring is a layer of a generic rf absorbing material 22.

Figure 4:
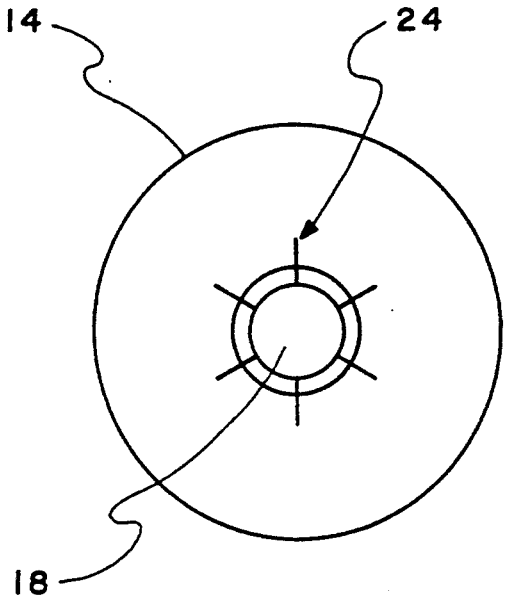
FIGS. 4 and 5 show two views of a typical iris of the mode trap of FIG. 3.
Figure 6:
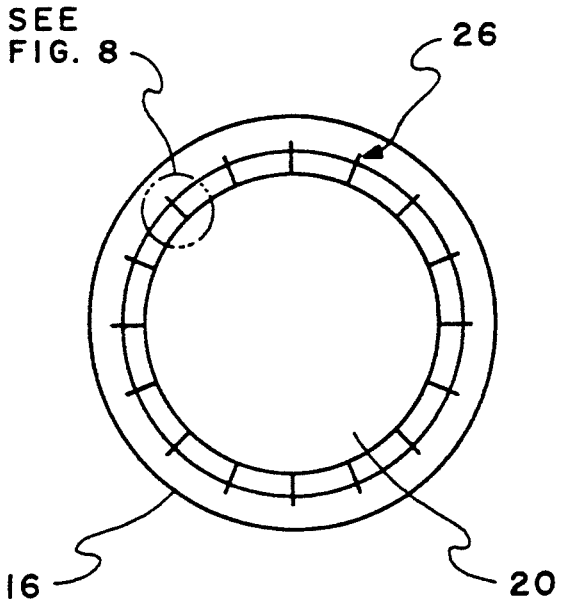
FIGS. 6, 7 and 8 show three views of a typical ring of the mode trap of FIG. 3; and, FIG. 9 shows another embodiment of a mode trap of the present invention.

Detailed views of a typical iris 14 and ring 16 are shown in FIGS. 4 and 6 respectively. Each iris and ring includes a centrally located aperture: the iris has an aperture 18, (see FIG. 4) and the ring has an aperture 20 (see FIG. 6). When a plurality of rings and irises are stacked in the side-by-side arrangement shown in FIG. 3 to form the waveguide 12, the apertures 18 and 20 of the irises and rings are concentric, with the aperture 20 of the ring 16 being larger than the aperture 18 of the iris 14.

Figure 5:
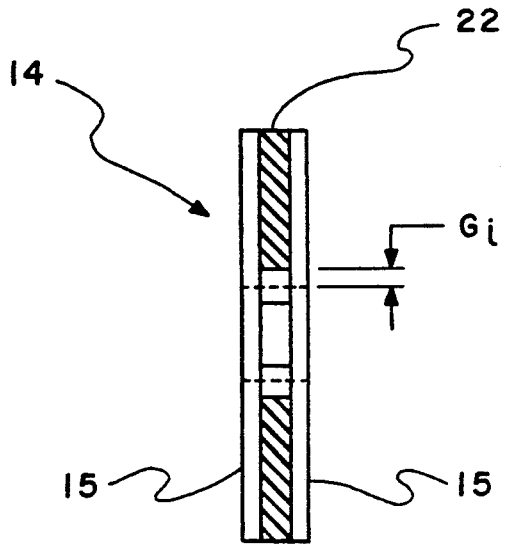
Figure 7:
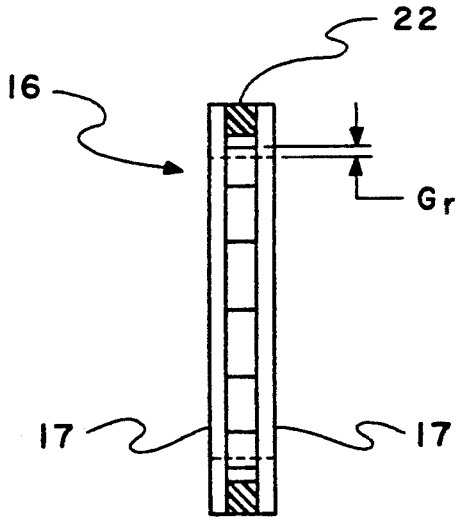
Figure 8:
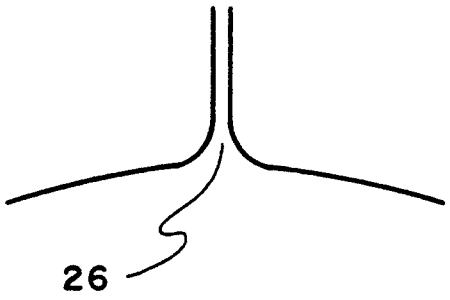

Side views of the iris 14 and ring 16 are shown in FIGS. 5 and 7, respectively. Each iris 14 and ring 16 can be considered as having outer electrically conducting layers 15 and 17, respectively (shown in FIGS. 5 and 7). In addition, each iris and ring includes a layer of a generic rf absorbing material 22 embedded or sandwiched between outer edges 15 (see FIG. 5) or 17 (see FIG. 7) of the iris 14 or ring 16. This layer of absorbing material, preferably a dielectric such as plastic or ceramic, is external to the waveguide 12 and surrounds the apertures 18 and 20 of the iris 14 or ring 16 in which it is embedded, but it is circumferentially spaced from the aperture opening. This location of the dielectric 22, "hidden" behind the outer edges 15 and 17, allows the accelerator mode to be contained and pass through the waveguide.

A plurality of notches or slots are cut into the irises and rings. As seen in FIG. 4, the iris 14 includes slots 24. The slots 24 are circumferentially spaced around the aperture 18 and extend from the aperture radially outward to the rf absorbing layer 22. The slots 24 extend through to the absorbing layer, passing through a small boundary of electrically conductive material between the aperture 18 and the absorbing layer 22, designated as $G_i$ (see FIG. 5). This provides a path for deflection-mode currents to the absorbing material 22, but accelerator-mode currents do not enter the slot 24 and are not attenuated by the absorbing material 22. It is important to note also that the slots 24, do not extend through to the outer edge of the iris 14. The slots 24 are wire cuts, as thin as possible and preferentially about 5–10 thousandths of an inch (mils) thick, cut to a radius of about 7/16 inches. It has been found that at least four slots 24 are required. The six, equi-spaced slots seen in FIG. 4 have been found to be a good compromise to achieve the desired damping effect of the transverse mode of the accelerator beam.

Similar to the slots 24 in the iris 14 are the slots 26 of the ring 16. As seen in FIG. 6, the slots 26 also extend from the aperture 20 radially outward to the rf absorbing layer 22, again passing through a small boundary of electrically conductive material between the aperture 20 and the absorbing layer 22, designated as $G_r$ (see FIG. 7). It is important to note also that like the slots 24, the slots 26 do not extend through to the outer edge of the ring 16. The ring 16 of FIG. 3 includes sixteen equi-spaced slots 26 about 5–10 mils thick, and cut to a radius of about $\frac{7}{8}$ inches. The slots 26 of the ring are rounded at the inner edges of the aperture. This rounding eliminates sharp metallic boundaries that arc under the influence of high electric fields.

A waveguide 12 according to the present invention can have a diameter of about 2 inches, with the irises and rings each having a thickness of about 5/16 inches. The length of the waveguide with irises and rings of these dimensions, and thus the number of irises 14 and rings 16 needed to construct a waveguide, would be about ten meters. An accelerator operating at a lower frequency would have larger irises 14 and rings 16 and have fewer of them, each section less than a meter in length. It is contemplated that a waveguide section utilizing the present invention can have as few as eight irises and rings, and as many as one hundred. A complete accelerator would consist of many sections placed end to end, the total number of sections depending on the particular application. In operation, when a beam having a transverse mode and an acceleration mode passes through the waveguide, the transverse mode, which moves from side-to-side, gets absorbed by the dielectric layer 22 by passing through the slots 24 and 26 in the irises and rings. The boundaries Gi and Gr between the apertures 18 and 20 and the dielectric layer 22 keeps the accelerator mode contained, which moves longitudinally forward and backward and does not enter the slots 24 and 26.

Figure 9:
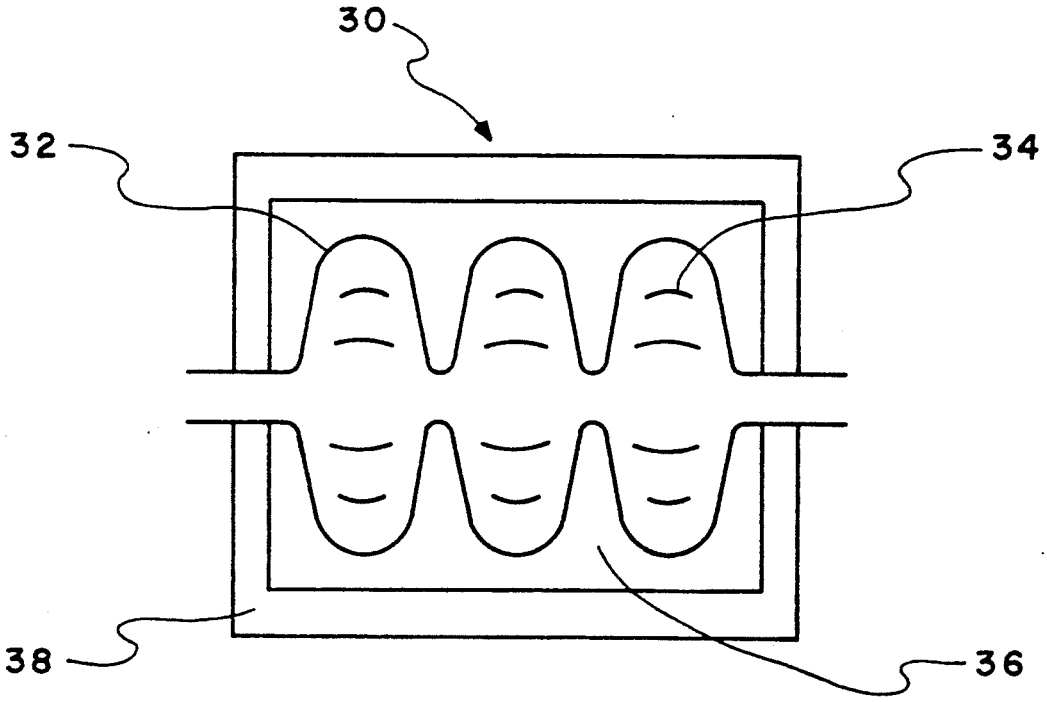

Another embodiment of a mode trap in accordance with the present invention is shown in FIG. 9. Here, the waveguide 30 is a niobium-lined cavity 32 having thin longitudinal strips of copper 34 exposed to the interior to attenuate azimuthal wall currents. The niobium-lined copper cavity 32 is surrounded by a liquid helium jacket 36, which in turn is surrounded by a liquid nitrogen jacket 38. This embodiment dampens the transverse mode according to the same principle as the previous embodiment, with the copper strips on the niobium lined wall of the copper cavity serving to attenuate the azimuthal wall currents, but not the longitudinal. Due to the superconducting property of niobium, very little external power is required to provide a large accelerations field, but likewise, the very low loss of the material allows deflection modes to persist indefinitely, eventually building to beam destructive levels. Thus the above described transverse damping would be greatly beneficial.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application and thereby enable others skilled in the art to best explain the principles of the invention and its practical application and thereby enable others skilled in the art to best utilize the invention is various embodiments and with various modifications as are suited to the particular use contemplated. It is intended that the scope of the invention be defined by the claims appended hereto.

The embodiments of the invention in which exclusive property rights or privileges are claimed are defined as follows:

1. In a linear accelerator comprising a waveguide that accelerates an electron beam passing therethrough, the electron beam having a transverse mode and an accelerator mode associated therewith, a mode trap to trap and absorb the transverse modes passing through the waveguide while allowing the accelerator mode to pass through the waveguide, the mode trap comprising:

a multiplicity of electrically conductive irises and rings, each iris and ring including a respective aperture, and the irises and rings stacked in a side-by-side, alternating fashion such that the apertures of the irises and rings define the waveguide;

an absorbing material layer embedded in each iris and ring, the absorbing material layer encircling, but spaced from the respective aperture;

each iris and ring further including a plurality of slots spaced around the respective aperture and extending out toward the respective absorbing material layer;

whereby the transverse mode of the accelerator beam is channeled through the slots in the rings and irises and is absorbed by the absorbing layer, without limiting the accelerator mode of the accelerator beam.

2. The mode trap of claim 1 wherein each iris has at least four equi-spaced notches.

3. The mode trap of claim 2 wherein each ring has sixteen equi-spaced notches.

4. The mode trap of claim 3 wherein the absorbing material layer in each of the rings and irises is a dielectric.

5. The mode trap of claim 4 wherein the slots of the rings have rounded edges at the aperture.

6. The mode trap of claim 5 wherein the irises and rings are comprises of copper.

* * * * *